US005375836A

United States Patent [19]

Kiser

[11] Patent Number: 5,375,836

[45] Date of Patent: Dec. 27, 1994

[54] SPORTS TRAINING EQUIPMENT

[76] Inventor: Darryl A. Kiser, 2508 Minn. Ave. Apt. P-262, Lynn Haven, Fla. 32444

[21] Appl. No.: 169,388

[22] Filed: Dec. 20, 1993

[51] Int. Cl.[5] ..... A63B 69/00

[52] U.S. Cl. ..... 273/26 C

[58] Field of Search ..... 273/26 C, 26 R, 29 A

[56] References Cited

U.S. PATENT DOCUMENTS

| | | | |
|---|---|---|---|
| 4,746,118 | 5/1988 | Deveney | 273/26 C |
| 4,875,677 | 10/1989 | Tetreault | 273/26 C |
| 4,886,267 | 12/1989 | Liccardi et al. | 273/26 R |
| 4,886,467 | 12/1989 | Peveto | 439/192 |
| 5,087,039 | 2/1992 | Laseke | 273/26 R |
| 5,114,142 | 5/1992 | Gillespie et al. | 273/26 C |
| 5,154,416 | 10/1992 | Smull et al. | 273/26 C |

*Primary Examiner*—William H. Grieb

*Attorney, Agent, or Firm*—Darryl A. Kiser

[57] ABSTRACT

This invention is a baseball training apparatus, which attaches to the lower torso by way of a four inch wide VELCRO belt. It has an adjustable arm support for proper positioning of the back arm and to insure that he batter develops not only a correct swing, but also a consistent swing. The arm support adjust at an equal rate for a variety of torso and upper arm lengths at a 45 degree angle in such a manner that 1 inch vertically will equal 1 inch horizontally. The apparatus is designed to teach a proper swing, but not a proper stance, being that the apparatus is connected to the torso, it allows for a full range of motion for the batter, since adjusting his stance is determined by the batter's own sense of balance as the batter moves, the back arm stays in the correct position.

4 Claims, 9 Drawing Sheets

SPORTS TRAINING EQUIPMENT

SUMMARY OF INVENTION

This invention is a baseball batting training apparatus, which is designed to correct a multitude of batting errors encountered universally by baseball players. It enables the batter to properly position the back arm height for the beginning point of the swing, which must be consistent for successful batting. The vertical angle of the arm rest insures that the back of the rear arm does not get out of line with the back of the shoulders. The downward sloping angle of the arm rest allows the batter to swing at low or high pitches without constricting movement. The adjusting arm piece is positioned to adjust to any arm or torso size and length by means of a 45 degree vertical angle and a 33 degree angle back from the front member of the main body support. This is in such a manner that the ratio is as follows: one inch vertical=one inch horizontal. The main body support being attached to the body by means of a VELCRO strap allows movement of the body while keeping the arm in the proper position. Also the fact that this device is non-constricting enables the batter to strike the pitched ball and proceed to first base for completion of a hitting cycle, unlike anything existing in the related art.

BACKGROUND OF INVENTION

In the past, devices developed to train or guide bat swings have not allowed for variances in positions of the baseball pitch or swing. They required too many fixed positions that do not occur in the reality of a baseball game. Through research of the swings of baseball players with the highest batting averages, it has been discovered that players need more range of mobility to feel comfortable in their swing and to be successful.

In U.S. Pat. No. 4,886,267, for a Baseball Practice Apparatus, the device was constructed to aid proper positioning of a batter's elbow and back arm. The batter must place his back arm against a "swing guide" and swing at a baseball placed on an elevated tee. This does not allow the batter to back swing with his arms and torso, which is required for a proper swing. In addition, according to its design, the "swing guide" is in direct line with the center of the home plate. As a result of this, when the back arm is touching the "swing guide", then the hands are already over the center of the plate, which means that half of the distance that the hands would normally travel in a complete and proper swing has already been completed.

In U.S. Pat. No. 5,087,039, for a Baseball Swing Training Device, the device was designed to aid the batter in proper positioning of his swing. The batter must swing his bat between two parallel bars on a downward slope and hit a ball resting on a tee on the bottom member. He must also continue swinging the bat in a downward motion. The device does not allow the bat to have a "follow-through" into an upward motion so that the swing will create a driving force behind the ball.

In contrast to the above devices, this invention allows the most realistic baseball batting practice by the batter using the device. As a result of this, the batter can feel more confident when placed in a real baseball game. All features of this invention include the arm positioner, the size, and being attached to the body. Thus, these features allow for the most movement of the batter, while teaching the most basic skill in batting, (that being keeping the rear forearm at a right angle to the body, while in line with the shoulders). If the full rear arm is not in the proper position and is closer to the body, it restricts movement of the arms and bat, thus making the batter unable to complete a proper swing.

Figure 1:
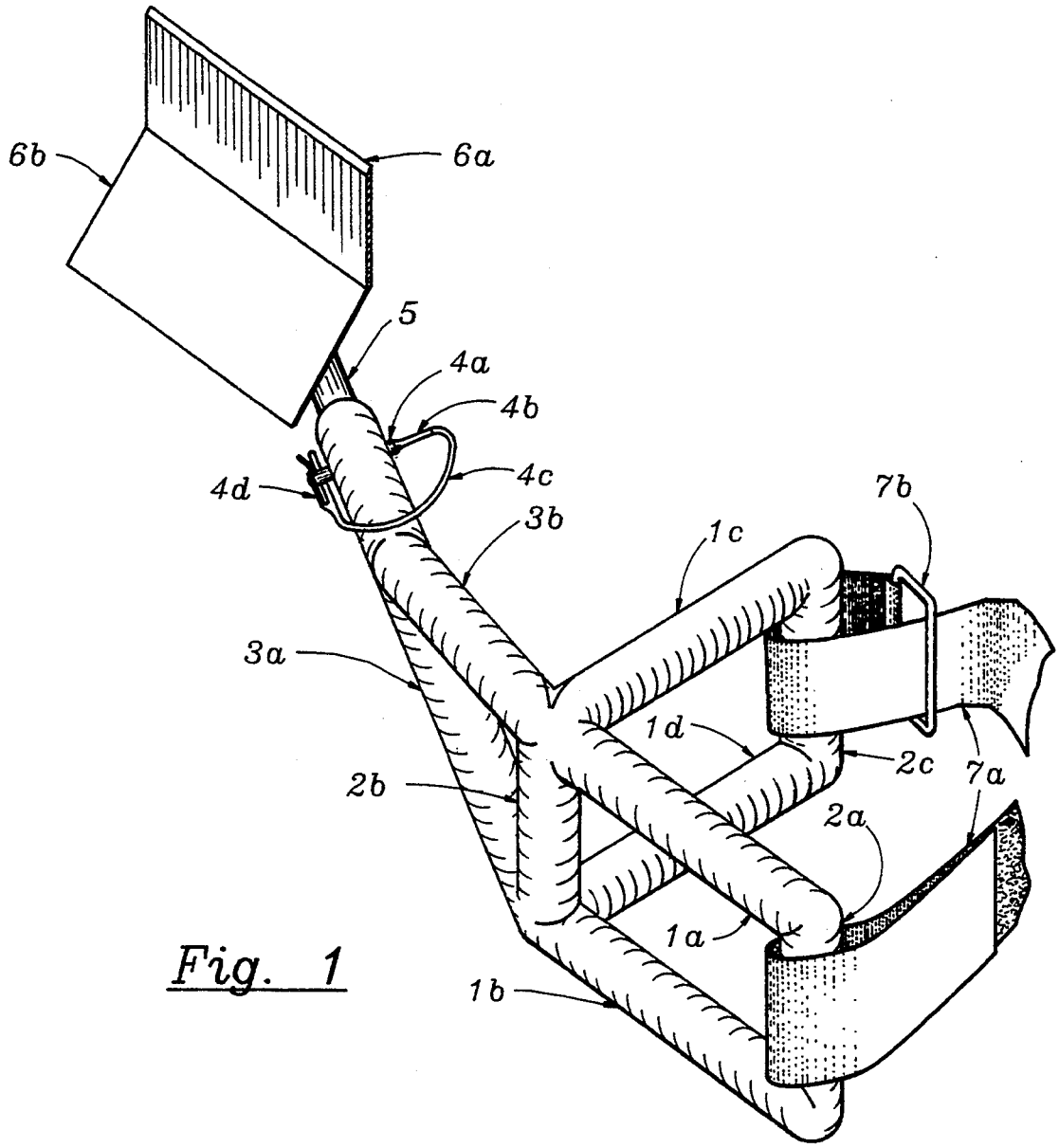
FIG. 1 shows a perspective view of the invention.
Figure 2:
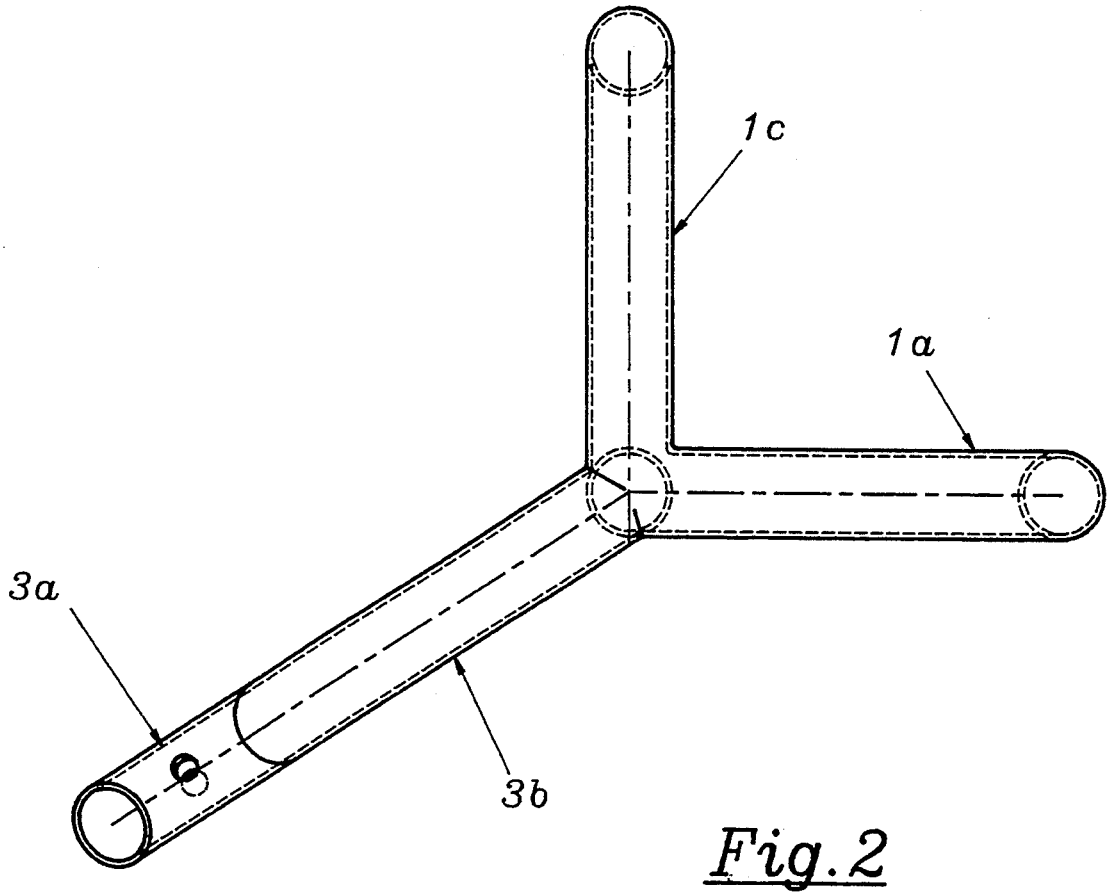
FIG. 2 shows a top view of a portion of FIG. 1.
Figure 3:
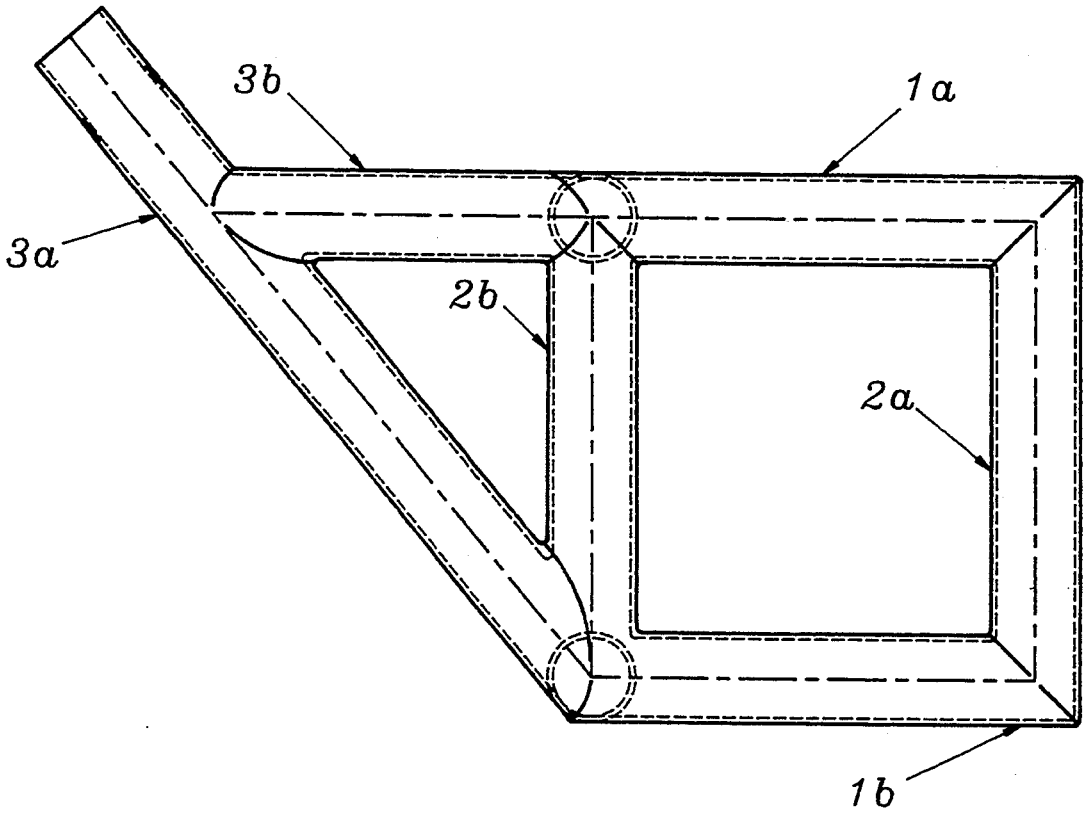
FIG. 3 shows a left side view of a portion of FIG. 1.

1*a*. Upper anterior horizontal member of main body support

1*b*. Lower anterior horizontal member of main body support

1*c*. Upper posterior horizontal member of main body support

1*d*. Lower posterior horizontal member of main body support

2*a*. Anterior vertical member of main body support

2*b*. Exterior vertical member of main body support

2*c*. Posterior vertical member of main body support

3*a*. Angled main body arm positioner support

3*b*. Horizontal main body arm positioning brace

4*a*. Adjusting pin for securing adjustable arm positioner to angled main body arm positioner support.

4*b*. Pull tab for easy removal of pin

4*c*. Umbilical cord

4*d*. Pin Key

5. Adjustable arm positioner

6*a*. Vertical arm support

6*b*. 135° arm support guide

7*a*. 4 inch wide Velcro belt

7*b*. Molded Zytel cinch ring

8. Top View of batter's torso

DETAILED DESCRIPTION OF THE PREFERRED EMBODIMENT

ELEMENTS 1–3 are the main body support for a baseball training apparatus. The main body support is attached to the batter by a 4 inch wide VELCRO Belt 7*a* with a 4 inch molded Zytel cinch ring 7*b*. It is then fastened around the batter's torso and looped around the anterior vertical member 2*a* of the main body support, from the inside looping through and back around, thus allowing the Velcro to attach to itself.

The main body support consists of three vertical members: 2*a*, the anterior member of the main body support, 2*b*, the exterior vertical member of the main body support, 2*c*, posterior vertical member of main body support which are attached to four horizontal members: 1*a*, the upper anterior horizontal member of the main body support, 1*b*, lower anterior horizontal member of the main body support, as well as 3*a*, the angled main body arm positioner support, joined at the bottom of 2*b*, the exterior vertical member of main body support. 3*a*, the angled main body arm positioner, is further supported by 3b, the horizontal main body arm positioner beach, which is also connected to the intersection of the upper anterior horizontal member of main body support 1a, upper posterior horizontal member of main body support 1c, and the exterior vertical member of main body support 2b.

NOTE: 1a, 1b, 1c, 1d, 2a, 2b, 2c, 3a, and 3b are of one piece pigmented linear low polyethylene rotational molding construction.

A hole to interrelate with 4a, the adjusting pin for securing the adjustable arm positioner to angled main body arm positioner support, is located two inches from the upper end of 3a, the angled main body arm positioner support.

Figure 4:
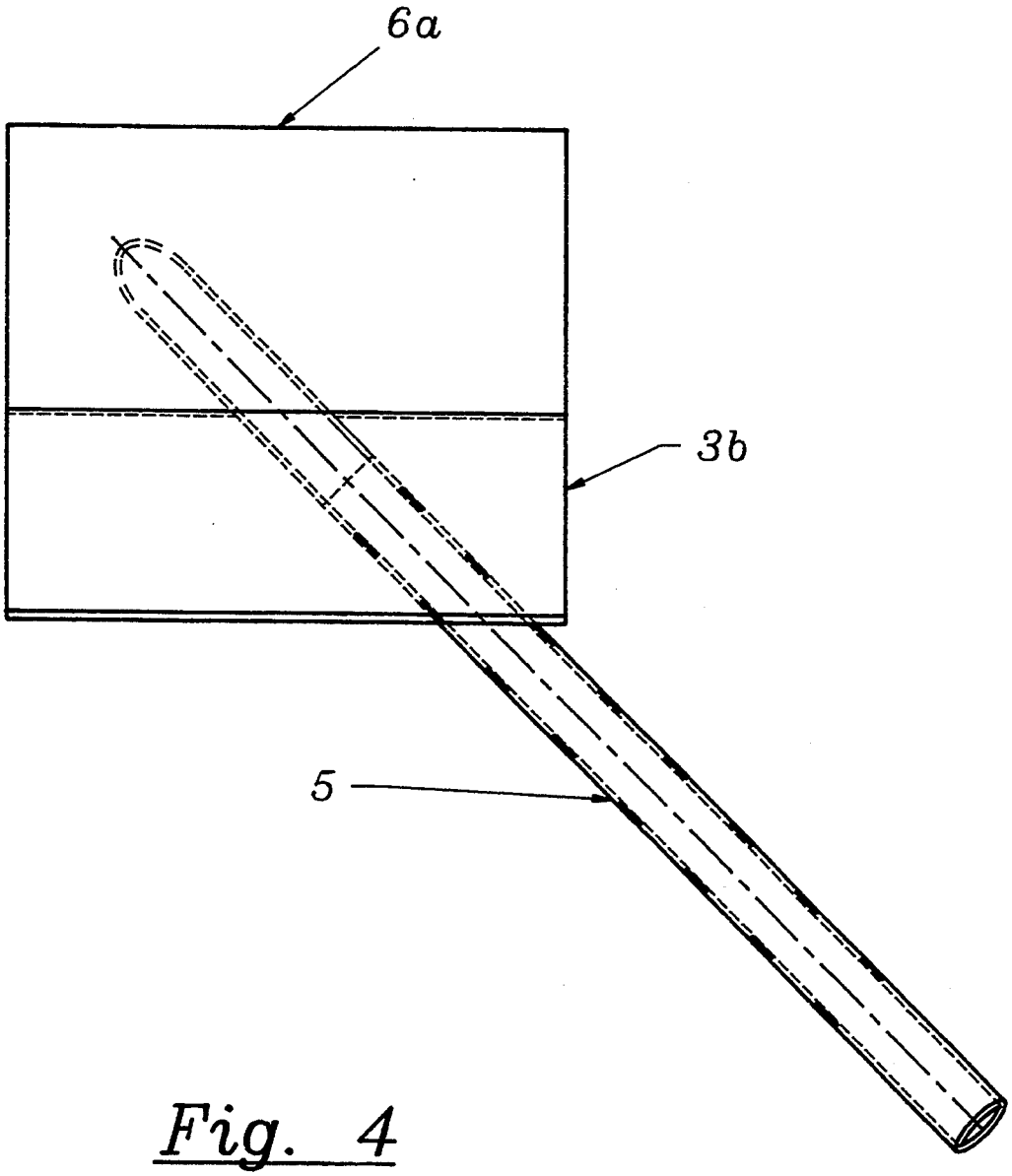
FIG. 4 shows the main body arm positioner support and adjustable arm positioner.
Figure 5:
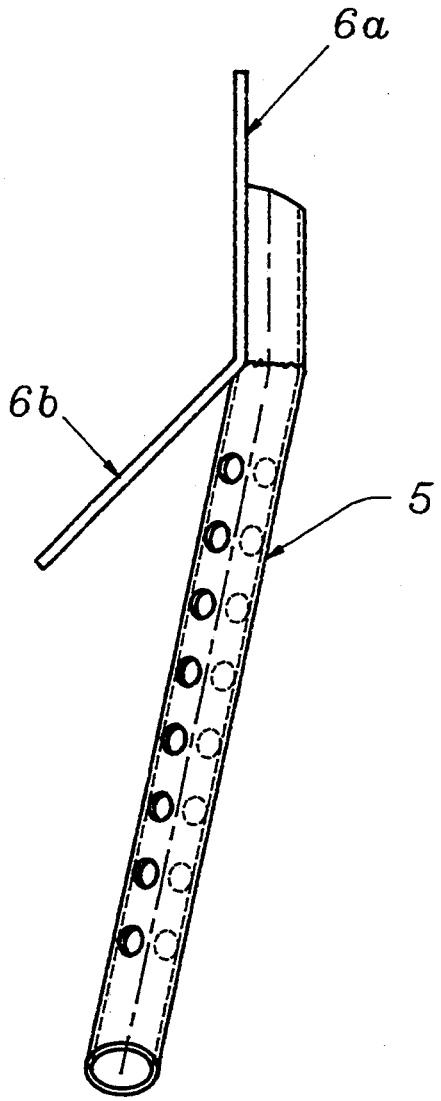
FIG. 5 shows a view of the vertical arm support and adjustable arm positioner.
Figure 6A:
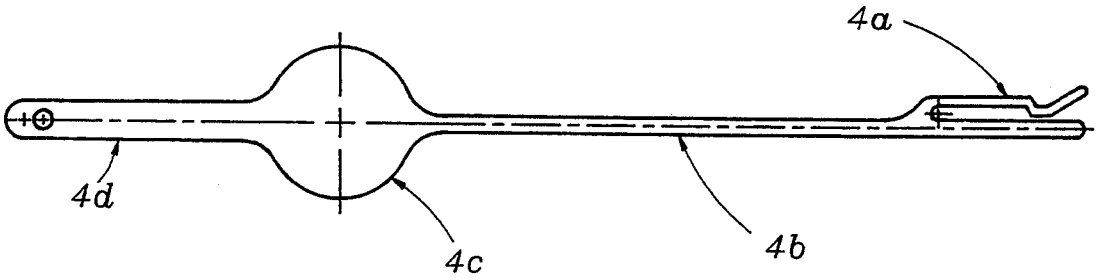
FIGS. 6*a* and 6*b* show the adjustable pin, pull tab, umbilical cord and pin key.
Figure 6B:
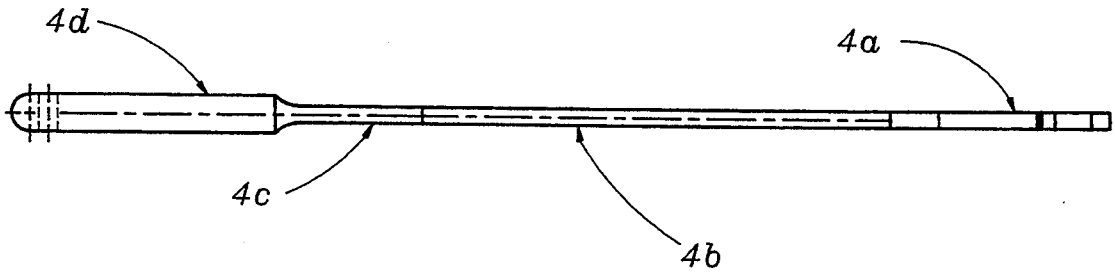
Figure 7:
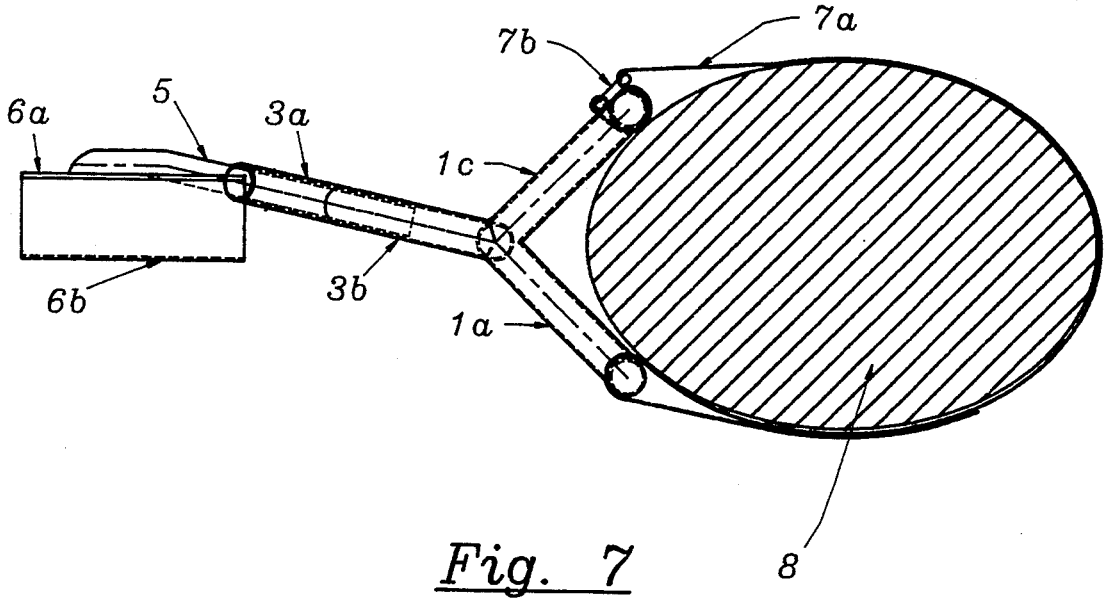
FIG. 7 shows a top view of a batter's torso with the invention attached thereto.
Figure 8:
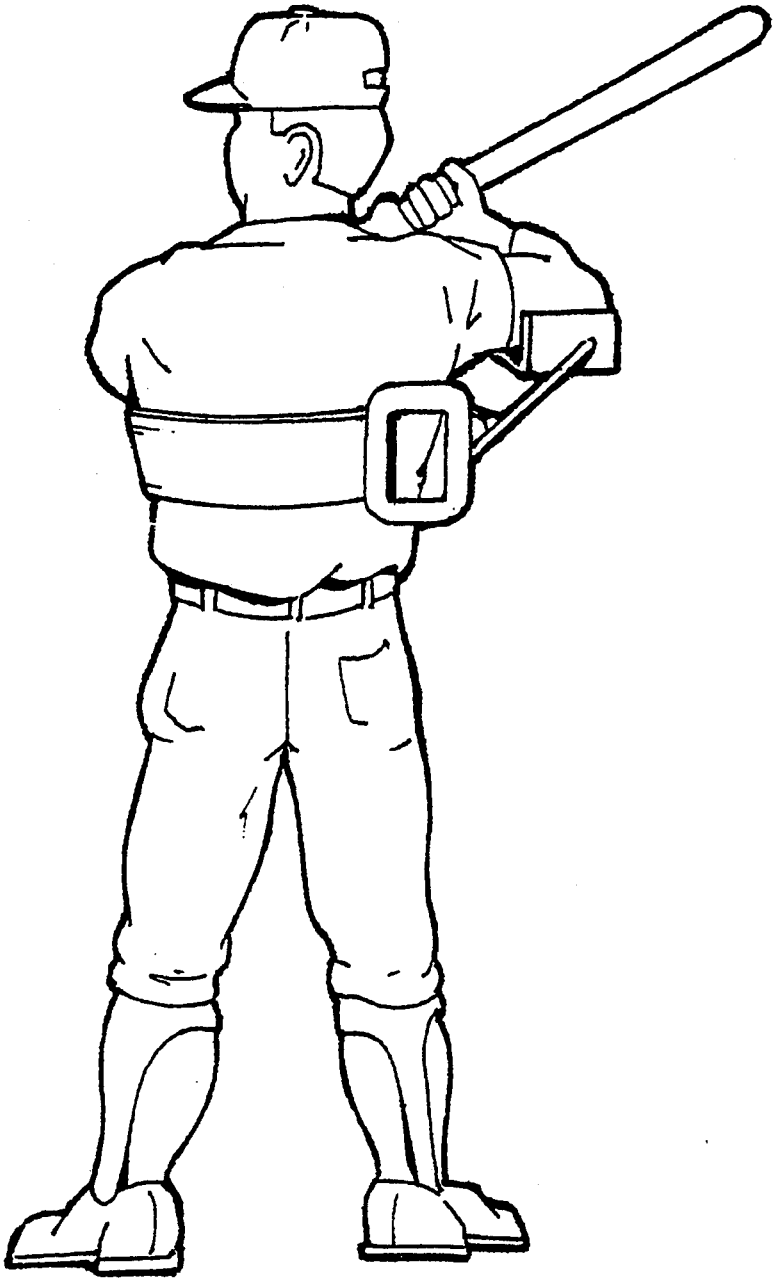
FIG. 8 shows a view of a batter wearing the invention.

Referring to FIGS. 1, 4, and 5, 5 is an adjustable arm positioner slip that fits into 3a, the angled main body arm positioner support to properly adjust 6a, the vertical arm support and 6b, the 135 degree arm support guide at the proper height to insure that the batter is at the correct beginning point for optimal swing efficiency. The vertical arm support 6a will provide the batter with the correct distance of their back swing, while the 135 degree arm support 6b will guide the batter's arm for the beginning of their forward projectory of the back arm during the swing, and insure that the back arm will not dip and cause the batter to up-cut his swing.

I claim:

1. A baseball batting training apparatus, which comprises:

a body support, attachable to a batter's body, a main arm positioner support extending from said body support, an adjustable are positioner fitted into said main arm positioner, an arm support attached to said adjustable arm positioner, said arm support comprising a first, vertically arranged portion and a second portion that slopes downward at a 135 degree angle from the vertical portion to support a batter's arm in a proper batting position.

2. The baseball training apparatus of claim 1, wherein the body support comprises;

a main body support, two sets of horizontal parallel bars connected to each other at one end at a 90 degree angle by a vertical post, and at their other ends by a belt which spans the batter's torso.

3. The baseball training apparatus of claim 1, wherein the adjustable arm positioner has;

a plurality of sets of openings spaced equidistant from each other along a portion of its length, and an interlocking pin adapted to selectively engage one of said sets of openings to maintain said adjustable arm at a selected extended position with respect to said main arm positioner support.

4. The baseball training apparatus of claim 3, further comprising;

a pull tab, cord and lock key to secure said pin in place in a selectively engaged set of openings.

* * * * *